US009299216B2

(12) United States Patent
Pertgen et al.

(10) Patent No.: US 9,299,216 B2
(45) Date of Patent: Mar. 29, 2016

(54) METHOD, SYSTEM, AND DEVICE FOR GENERATING A CURRENT GAME DISPLAY

(71) Applicants: Michael Pertgen, Las Vegas, NV (US); Robert Ryan Morishita, Las Vegas, NV (US)

(72) Inventors: Michael Pertgen, Las Vegas, NV (US); Robert Ryan Morishita, Las Vegas, NV (US)

(73) Assignee: Check or Bet Gaming, Inc., Las Vegas, NV (US)

( * ) Notice: Subject to any disclaimer, the term of this patent is extended or adjusted under 35 U.S.C. 154(b) by 0 days.

(21) Appl. No.: 14/476,178

(22) Filed: Sep. 3, 2014

(65) Prior Publication Data

US 2014/0370955 A1 Dec. 18, 2014

Related U.S. Application Data

(63) Continuation-in-part of application No. 14/182,214, filed on Feb. 17, 2014, now Pat. No. 9,202,343, which is a continuation-in-part of application No. 13/654,921, filed on Oct. 18, 2012, now Pat. No. 8,651,932.

(60) Provisional application No. 61/888,446, filed on Oct. 8, 2013.

(51) Int. Cl.
*G07F 17/32* (2006.01)

(52) U.S. Cl.
CPC ..... *G07F 17/323* (2013.01); *G07F 17/3244* (2013.01)

(58) Field of Classification Search
CPC ..... G07F 17/32
USPC ..... 463/16
See application file for complete search history.

(56) References Cited

U.S. PATENT DOCUMENTS

| | | | | |
|---|---|---|---|---|
| 6,237,916 | B1 * | 5/2001 | Webb | 273/292 |
| 2005/0288084 | A1 * | 12/2005 | Schubert | 463/11 |
| 2006/0223605 | A1 * | 10/2006 | Pullman | 463/16 |
| 2009/0061975 | A1 * | 3/2009 | Ditchev | 463/13 |

* cited by examiner

*Primary Examiner* — Omkar Deodhar
(74) *Attorney, Agent, or Firm* — Robert Ryan Morishita

(57) ABSTRACT

A method and system for generating a current game display includes receiving data indicating the commencement of a current game, receiving data representing a random event in the current game, determining a current game state at an intermediate point in the game prior to the end of the game, generate a current game display at the intermediate point, and display the current game display at the intermediate point. In an optional embodiment, wagers may be received prior to commencement of the game and/or at the intermediate point and resolved at the end of the game.

18 Claims, 9 Drawing Sheets

METHOD, SYSTEM, AND DEVICE FOR GENERATING A CURRENT GAME DISPLAY

RELATED APPLICATION DATA

The present application is a continuation-in-part of U.S. patent application Ser. No. 14/182,214, entitled "Method and Device for Conducting a Wagering Game," filed Feb. 17, 2014 which, in turn, is a continuation-in-part of U.S. patent application Ser. No. 13/654,921, entitled "Method and Device for Conducting a Wagering Game," filed Oct. 18, 2012 and issued Feb. 18, 2014 as U.S. Pat. No. 8,651,932.

FIELD OF THE INVENTION

The present invention relates to systems and methods for conducting games. More specifically, the present invention is a system and method for conducting a current game display at a live, electronic, or live/electronic game by converting game indicia selected and dealt at the live, electronic, or live/electronic game to a data stream for generating a game display for the current game and/or current hand.

BACKGROUND OF THE INVENTION

Live games, such as live table games, keno, bingo, and the like, are well known in the casino gaming industry. Most of the recent development in live games, however, has been in producing new games, such as Spanish 21™ or Let It Ride™, developing new side bets for existing games, such as the Lucky Ladies side bet for blackjack, or networking live games to produce large, progressive jackpots, rather than using the live game to produce a separate and independent game to draw new players who may be uncomfortable with the live game format.

Additionally, players are accustomed to using technology, such as smart phones, tablet devices, or the like, to gather information. While certain live table games, such as roulette and baccarat (as well as baccarat variations), utilize game history displays to display past hands, no current live or electronic table games utilize displays for information in the current game and/or current hand.

Electronic casino games have increased in popularity. With the rise in popularity, and because electronic casino games are often less expensive to operate, much innovation has taken place in the electronic casino game industry. These include linked and standalone jackpots, community gaming, internet gaming, mobile gaming, server-based gaming, and a myriad of other developments that span a variety of categories. Even when electronic casino games are based on the same or similar mathematical model, computer graphics and animation can make the same game look completely different across different gaming machines.

Thus, it can be seen that there is a need in the art for a system and method for conducting a current game display at a live or electronic game by converting game indicia selected and dealt at the live or electronic game to a data stream for generating a game display for the current game and/or current game.

SUMMARY OF THE INVENTION

The present invention includes a method, system, and device for generating a current game display. In one embodiment, the present invention includes a method for generating a current game display for a game. The game optionally includes at least one intermediate point during the game and a final outcome at the end of the game based on at least one random event occurring in the game. The method is optionally conducted using a display in communication with a controller. Optionally, the controller is configured to execute program instructions to conduct the method.

In one such optional embodiment, a current game is commenced. Optionally, an ante wager is received prior to the step of commencing the current game.

Data are received at the controller representing at least one random event that has occurred in the current game prior to the intermediate point. That is, in one optional embodiment the data represent at least one random event, such as one or more randomly selected game indicia (e.g., playing cards, dice, tiles, balls, numbers, or the like), that occurs between commencement of the current game and an intermediate point in the current game.

The controller determines the current game state at the intermediate point during the current game based on the data received. The controller generates a current game display based on the current game state determined by the controller. For example, in one optional embodiment, the game state may include a quantification of the probability of a random event that determines, at least in part, the final outcome. In another optional embodiment in which the final outcome could be a winning outcome or a losing outcome, the game state may include a quantification of the probability of the final outcome being at least one of a winning outcome or a losing outcome.

The current game display is displayed at the intermediate point during the current game and prior to the final outcome at the end of the current game. In an optional embodiment including an ante wager, the ante wager may be resolved at the end of the current game based, at least in part, on the final outcome.

In a further optional embodiment, at least one wager is received after the current game display is displayed. The wager is resolved at the end of the current game. Thus, in such an optional embodiment, the wager is placed with the knowledge of the game state represented by the current game display. For example, in one optional embodiment, the current game display includes a dynamic pay out for the wager in which the dynamic pay out is calculated, at least in part, based on the current game state.

An embodiment of the present invention also includes a system for generating a current game display. Such a system may be directed to a game including at least one intermediate point during the game, and a final outcome at the end of the game that is determined based on at least one random event occurring in the game.

In one such optional embodiment, the system includes a controller and a display in communication with the controller. In an optional embodiment, the controller is configured to execute program instructions to conduct a method. The method optionally includes receiving data at the controller indicating the commencement of a current game. After the game commences, data are received at the controller representing at least one random event that has occurred in the current game prior to the intermediate point. For example, in an optional embodiment in which the game is conducted using game indicia, the system may include an optical reader in communication with the controller. In one such optional embodiment, the optical reader is configured to read the game indicia and transmit data representing the game indicia to the controller. It is contemplated that the optical reader may be integrated into another device in the system. For example, in one optional embodiment, the system includes a playing card shoe and the optical reader is integrated with the playing card shoe. In another example, the system includes a playing card shuffler and the optical reader is integrated with the playing card shuffler. In yet another example, the system includes a gaming table wherein the optical is embedded into the gaming table.

The controller determines the current game state at the intermediate point during the current game based on the data received and generates a current game display based on the current game state determined by the controller. For example, in one optional embodiment, the game state includes a quantification of the probability of a random event that determines, at least in part, the final outcome. In another example, the final outcome could be a winning outcome or a losing outcome and the game state includes a quantification of the probability of the final outcome being at least one of a winning outcome or a losing outcome.

The display is configured to display the current game display at the intermediate point during the game and prior to the final outcome at the end of the game. At least one wager is received after the current game display is displayed, with the wager resolved at the end of the game. In one such optional embodiment, the current game display includes a dynamic pay out for the wager. In one such optional embodiment, the dynamic pay out is calculated, at least in part, based on the current game state.

Thus, in one specific example, the game utilizes game indicia selected and dealt in the game to generate a game outcome. The current game display may be specific to a particular hand, such as a particular player hand, a particular dealer hand, a particular community hand, or the like, or the current game display may be directed to multiple hands (such as a player hand and banker hand, or the like)

A controller and a display in communication with the controller are provided. The controller executes program instructions to receive data at the controller representing game indicia dealt in the current game. In one optional embodiment, game indicia are represented by physical game pieces. In one such optional embodiment, an optical reader is provided. Optionally, the optical reader may be incorporated into a playing card shoe, a playing card shuffler, a gaming table, or the like. In one such optional embodiment, game indicia are read from the physical game pieces at the optical reader and data representing the game indicia are transmitted from the optical reader to the controller. In another optional embodiment, the game indicia are represented by electronic game pieces at an electronic gaming device. In one such optional embodiment, the electronic gaming device transmits data representing dealt game indicia to the controller. Optionally, a game history may be stored at a data storage in communication with the controller. The game history may include at least a record of the data representing the game indicia dealt.

Optionally, a wager is received. Wagers may be received from players in the game or participants who are not players of the game, e.g., back-bettors. A game is conducted. A current game state is determined based on the data received at the controller in the underlying game in which the game indicia were dealt. A current game display is generated based on the current game state. Specifically, in an optional embodiment in which data representing game indicia come from a single game, the current game state is determined based on the specific hands dealt in that single game and the current game display is generated based on the current game state. In an optional embodiment, the current game display includes a display of the game indicia dealt to a specific hand. In a further optional embodiment, the current game display includes a display of possible options associated with play of the specific hand, such as alternative options for setting the hand, making play decisions, making bets, or the like. In yet a further optional embodiment, the current game display includes a display of possible options associated with play of the specific hand with a measure quantifying the differences between the options. In yet a further optional embodiment, the current game display includes a display of dynamic payouts or dynamic pay tables that vary depending on the current game (e.g., a community hand, a player hand, a dealer hand, or the like). In another optional embodiment, the current game display includes a display of the likelihood of a winning or losing outcome in the game.

The current game display is displayed at the display. Optionally, the current game display is specific to each player (or player hand) and is updated for each player (or player hand). In other optional embodiments, the current game display is directed to community hands and, thus, is shared by all the players.

In a further optional embodiment, the current game display may also serve as an informational display. In one such optional embodiment, the current game display may display messages, offers, information, news, or other information. In yet another optional embodiment, the controller may calculate payouts and the current game display may display the calculated payouts.

A system for conducting a current game display includes a display and a controller in communication with the display. The controller is adapted to execute program instructions to receive data at the controller representing game indicia dealt in the game. The controller determines a current game state based on the data received in the game in which the game indicia were dealt. A current game display is generated based on the current game state. The controller displays the current game display at the display. In an optional embodiment, the game is conducted for a plurality of players and the controller generates the current game display based on the data for each individual player. In an additional or alternate optional embodiment, the game is conducted for a plurality of players and the controller generates the current game display based on shared data (such as community hands) for all the players.

Optionally, the system includes a wager detector in communication with the controller adapted to receive wager data to be included in the data used by the controller in generating the current game display.

In an optional embodiment, the system may include an optical reader. In such an optional embodiment, the optical reader reads game indicia from physical game pieces and transmits data representing the game indicia from the optical reader to the controller. Optionally, the optical reader may be incorporated into a playing card shoe, playing card shuffler, or gaming table utilized with the system. In one optional embodiment, a single optical reader may be used to read a plurality of hands. In an alternate optional embodiment, the system includes a plurality of optical readers for a plurality of hands. In one such optional embodiment, the controller receives data representing game indicia from the plurality of optical readers and integrates the received data to generate a current game display for each hand read by the optical readers.

In an optional embodiment, the system includes an electronic gaming device. In one such optional embodiment, the electronic gaming device deals game indicia represented by electronic game pieces. In such an optional embodiment, data representing dealt game indicia is transmitted from the electronic gaming device to the controller. Optionally, a system may include a plurality of electronic gaming devices for a plurality of simultaneously conducted games. In one such optional embodiment, the controller receives data representing game indicia from an electronic gaming device and determines the current game state for the specific electronic gaming device from which the data were received (and thereby generates a current game display for the specific electronic gaming device for which the current game state was determined).

In an optional embodiment, the system includes a data storage in communication with the controller. The data storage is optionally adapted to store at least a history of data representing the dealt game indicia.

DESCRIPTION

Reference is now made to the figures wherein like parts are referred to by like numerals throughout. The present invention includes a method and system for generating and displaying a current game display for a live game. It is contemplated that the current game display may be applied to any live game. For example, the present invention may be applied to live table games, such as roulette, craps, pai gow, big wheel, live card games, or the like, live selection games, such as bingo, keno, or the like, or any other type of live game. As discussed in greater detail below, the present invention may be applied to games with a live or electronic dealer using live or electronic game pieces. That is, it is contemplated that the present invention includes, for example, a live game in which a computer-controlled dealer deals computer-generated game pieces as well as a live game in which a live dealer deals physical game pieces.

The current game display may take any form. That is, the current game display may be as straightforward as static display or may include animation, graphics, and/or interaction from one or more players. In an optional embodiment, player interaction with a current game display may influence the outcome of the game. For example, player interaction may increase or decrease the payout to the player(s). Alternatively, player interaction may inform and entertain the player(s) without affecting the outcome of the game. For example, a current game display may display information to advise the player on his or her options, but the exercise of those options by the player determines the outcome of the game rather than the display of those options. In other words, in such an optional embodiment, the current game display may reflect and display the current game state without affecting the current game state or game outcome.

Figure 1:
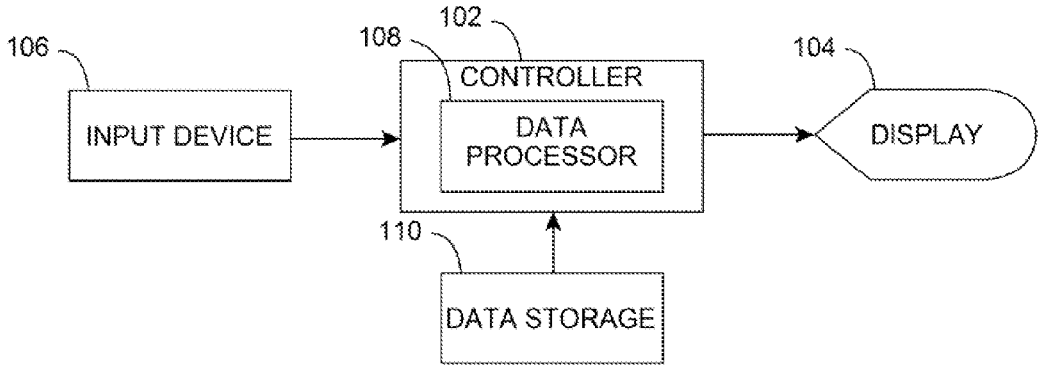
FIG. 1 is a block diagram of a system according to an embodiment of the present invention.
Figure 2:
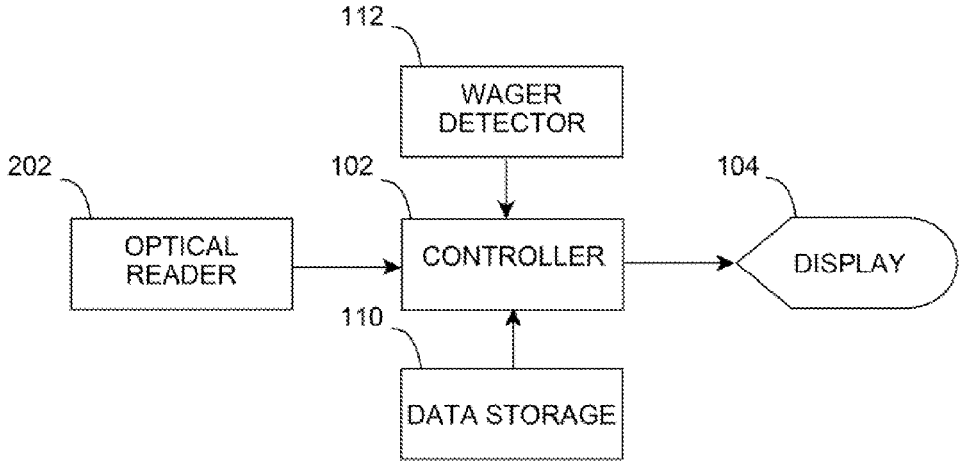
FIG. 2 is a block diagram of a system according to an embodiment of the present invention.
Figure 3:
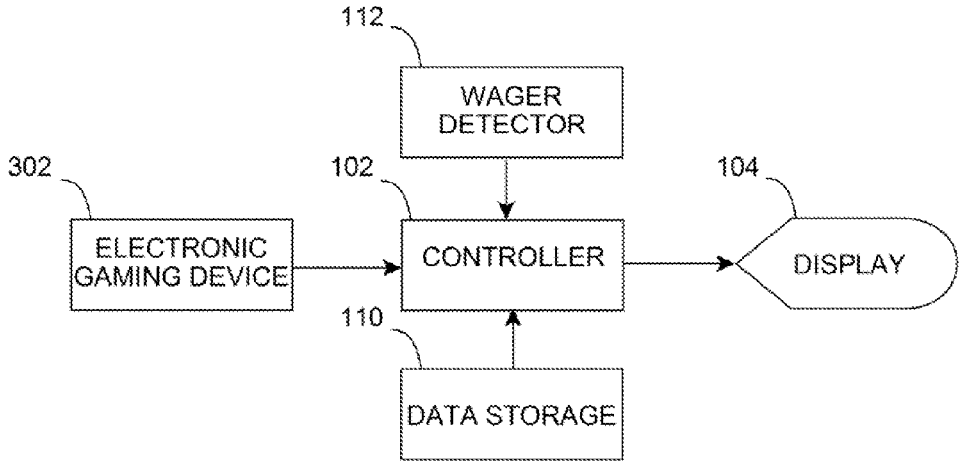
FIG. 3 is a block diagram of a system according to an embodiment of the present invention.

Referring to FIGS. 1-3, a method according to an embodiment of the present invention may be implemented through a system including a controller 102 communicating with a display 104. The controller 102 may take any form, including a general purpose computer, specific purpose computer, server, electronic gaming device, or the like. In an optional embodiment, the controller 102 communicates with an input device 106 for manually or automatically receiving data representing game indicia selected in the game. For example, the input device 106 may take the form of a button panel, keyboard, keypad, optical reader 202 (discussed in greater detail below), communication link, electronic gaming device 302 or the like. The controller 102 may also include a data processor 108. The data processor 108 may take any form, such as a microprocessor or the like.

The display 104 may take any form. For example, the display 104 may include a cathode-ray tube ("CRT") monitor, liquid crystal display ("LCD"), plasma display, organic light emitting diode ("OLED") display, or the like. The display 104 and controller 102 may communicate directly or indirectly, such as through a video controller or video card. In an optional embodiment, the display 104 may also function as an input device in the form of a touch screen device. Optionally, the display includes speakers and an audio board to generate or reproduce recorded speech, sound effects, music, or other sounds. It is contemplated that when the display 104 is not controlled to display a current game display, a display 104 may be controlled to produce an attract display, text such as game instructions, pre-recorded or live video, or the like, with or without accompanying sound.

In an optional embodiment, the controller 102 may communicate with a data storage 110. The data storage 110 may be local to the controller 102 or may be remote. The data storage 110 may include magnetic storage, optical storage, flash memory, electrically programmable memory, electrically alterable memory, or the like. As discussed in greater detail below, the data storage 110 may be directed by the controller 102 to store a variety of data including a game history.

Figure 4:
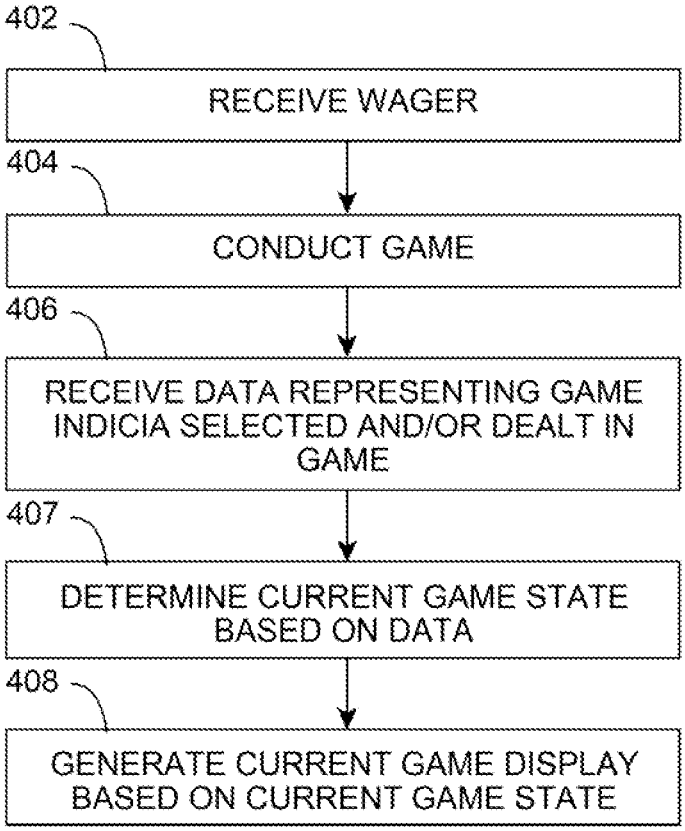
FIG. 4 is a flowchart of a method according to an embodiment of the present invention.
Figure 5:
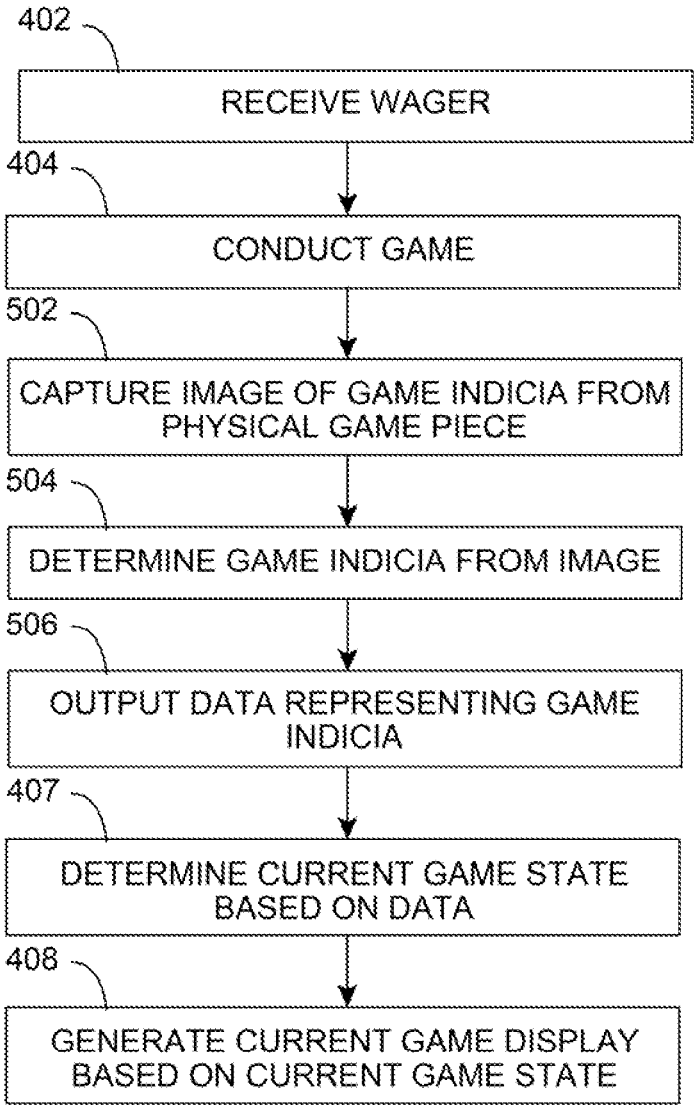
FIG. 5 is a flowchart of a method according to an embodiment of the present invention.

Referring to FIGS. 4 and 5, the present invention includes a method for generating a current game display for a game. By "current" it is contemplated that the controller 102 utilizes data to determine a "current game state" which is used to generate a "current game display" for the game being conducted when the "current game display" is generated and displayed. Specifically, while the current game display may include historical information, the characteristic which makes a current game display "current" is that the controller 102 generates and displays information for the current game being conducted.

In an optional embodiment, a wager is received 402. In an optional embodiment, a wager may be required for eligibility to participate in a game. Wagers may be received in any manner. In an optional embodiment, a wager may be received at a live gaming table, live counter (such as in bingo, keno, or the like), delivered to a live runner, or any other manner. In an further optional embodiment, wager detectors 112 may be provided. Wager detectors 112 may take any form, including a optical sensor, camera system, radio frequency identifier ("RFID"), or other bet sensor at a live table. Alternatively, a wager detector 112 may include an input device for physically or electronically inputting the wager or sensing the wager at an electronic gaming device, such as an electronic gaming table, video gaming machine, or slot machine. In yet another optional embodiment, a wager detector 112 may be integrated into an interface that receives electronic wagers at a live table or electronic gaming device.

The game is commenced and conducted 404 for at least one player, and optionally a dealer, using game pieces, such as physical playing cards, physical dice, physical tiles or dominoes, physical bingo or keno balls, and so forth, or as electronic game pieces, such as electronic playing cards, electronic dice, electronic bingo balls or keno balls, or the like. indicia. Game pieces are marked with game indicia. Game indicia may take any form and may be embodied in any manner. For example, game indicia may include numbers or alpha-numeric combinations, playing card values and suits, playing tile markings, dice values, roulette values and colors, slot machine symbols, or any other form of game indicia to determine a game outcome.

Game indicia used in the game are converted to data which is received 406 at the controller 102. In various optional embodiments, the data are received at the controller 102 in real time, periodically, or the like. The acquisition and conversion of game indicia can take any form. For example, as discussed above, an input device 106 may receive manual or automatic input of game indicia.

In one optional embodiment, game indicia may be manually input. For example, a user (such as a dealer) may input a selected game indicium, such as a playing card value and suit, playing tile marking, bingo number, keno number, roulette number, dice number, or the like, through a keyboard, keypad, touch screen, or other manual input device.

In another optional embodiment, game indicia may be automatically acquired. For example, an optical reader 202 may be embedded in a card shoe, a card shuffler, a gaming table, a ball blower, or the like, which captures 502 an image of the game indicia from a physical game piece. For example, an optical reader 202 may include a camera communicating with a processor running optical recognition software or firmware to determine 504 the game indicia from the image captured by the camera. The software or firmware may output 506 data representing game indicia which are received at a controller 102. As may be appreciated, such a camera could be mounted above a gaming table, in the surface of a gaming table, in a card shoe, in a card shuffler, in a ball blower, a combination of locations, or any other location where the camera can capture an image of the game indicia.

In yet another optional embodiment, data representing game indicia may be received at the controller 102 from an electronic gaming table, electronic ball blower, electronic roulette table, or other electronic gaming device 302 operated using a random number generator rather than a physical device. In one such optional embodiment, a map correlates numbers or number combinations to game indicia. As the random number generator generates numbers, the corresponding game indicia are determined from the map. In one such optional embodiment, data representing selected and/or dealt game indicia used in the game are transmitted to a controller 102 by the electronic gaming device 302.

By way of example, an optical reader 202 may be provided on or in a gaming table where data representing hands of playing cards are received at a controller 102. For example, a controller 102 may receive a data stream representing four player hands and one dealer hand in the current game. In an optional embodiment, the optical reader 202 may read, and the controller 102 may receive, the individual game indicia within each hand, in order, and group the game indicia into the hands. That is, in one such optional embodiment, the controller 102 may receive a data stream representing, or process a data stream to represent, individual hands with the game indicia of those hands in order. Again, it is contemplated that such a system may be applied to any game, whether it utilizes individual results (such as Blackjack) or shared results (such as Baccarat or Roulette).

As noted above, the controller 102 may communicate with a data storage 110. The data storage 110 optionally receives a game history from the controller 102, including the stream of data representing game indicia. In a further optional embodiment, game history may also include an identification of the source of the data, i.e., where the game indicia were selected and/or dealt, the time the data were received, the time or timing of the selection and/or dealing of the game indicia, and so forth. Such a game history may be searchable by the controller 102. In a further optional embodiment, such a game history may be searchable by players.

Based on the data received by the controller 102, the controller 102 determines 407 the game state at an intermediate point in the game. By "intermediate point," it is contemplated that the game state may be determined at any point in the game at or after commencement of the game but prior to the end of the game where the game outcome is determined. In one optional embodiment, the controller 102 executes program instructions to determine the game state from the data. That is, in one such optional embodiment, the data are the input to the controller 102 and the game state is the output of the controller 102.

The game state (and the program instructions for determining the game state) may vary depending on the game. Thus, in one such optional embodiment, the game state may be a projection of the likely outcome of the game. For example, in one such optional embodiment, the data may include a random event that occurred prior to the intermediate point when the controller determines the game state. The random event could take any form, including the dealing of one or more playing cards, one or more hands of playing cards, or one or more partial hands of playing cards; a randomly generated number (generated through any live or electronic device including a ball, wheel, reel, dice, or the like); the dealing of one or more tiles or one or more hands of tiles; or the like. For example, in the examples given below, the random event may include the dealing of a partial hand of playing cards or tiles.

The game state may include an analysis of the data. For example, the game state may include a relative ranking of hands, e.g., a Player hand is stronger than the Banker hand in a game of baccarat. In another such example, the analysis may include the relative strengths of various "ways" of playing a hand, e.g., setting a hand in a first "way" is stronger than setting the same hand in a second "way" in a game of pai gow or Pai Gow Poker™.

The game state may include a projection of an outcome based on the probabilities represented by the data. For example, the game state may include a projection of the likelihood of a hand outranking another hand, e.g., the probability of a first community hand versus a second community hand is projected to be 77% to win and 23% to lose or, stated differently, the first community hand has a 77% chance of beating the second community hand (bearing in mind that the probabilities may not add up to 100% due to the probability of a tie). In another example, the game state may include a projection of the likelihood of an occurrence based on different strategies or decisions that may be elected by the player, e.g., the probability of a player hand beating a dealer hand is projected to be 47% if the player stands and 68% if the player hits (bearing in mind that these are two different strategies so the probabilities do not necessarily add up to 100%). Some possible examples are given below in relation to specific games.

A current game display is generated 408 based on the current game state. The current game display may be generated 408 in any manner for the current game and may include any form of information. Specifically, the stream of data representing game indicia selected and/or dealt that is received at the controller 102 is used to generate 407 a current game state, which the controller then formats into a current game display. It is contemplated that a controller 102 may be programmed to utilize the data differently, and thus generate different current game displays, depending on the game.

Figure 6:
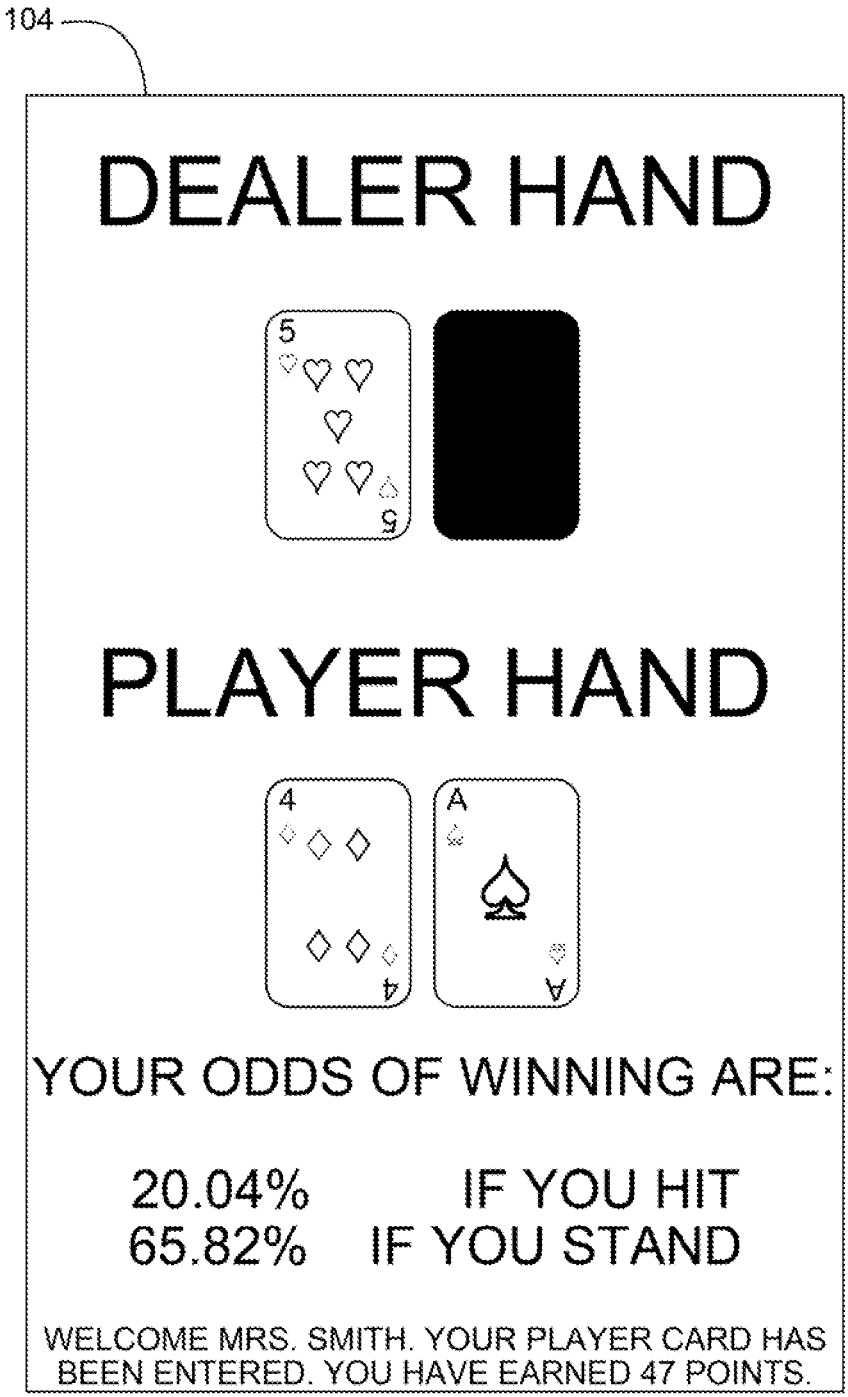
FIG. 6 is a front view of a current game display according to an embodiment of the present invention.

For example, in one optional embodiment applied to Blackjack as illustrated in FIG. 6, a current game display may be generated to display the player's hand and the player's hand sum. Moreover, the current game display may also include a calculation by the controller 102, based on an analysis of the player's hand, a dealer's hand (either the exposed card or the entire dealer hand), the other players' hands, and/or the undealt cards, of the likelihood of whether the player will win or lose if the player hits or stands. For example, such a current game display may be generated, for example, by determining the probability of the player making a hand (e.g., not busting), determine the likelihood of the final score of the player hand, determine the probability of the dealer making a hand (e.g., not busting), determine the likelihood of the final score of the dealer hand, and compare all those probabilities. This comparison may then be displayed to the player in any manner, including as simple as a current game display which states that the player has a 20.04% chance of winning if the player hits and a 65.82% chance of winning if the player stands.

Figure 7:
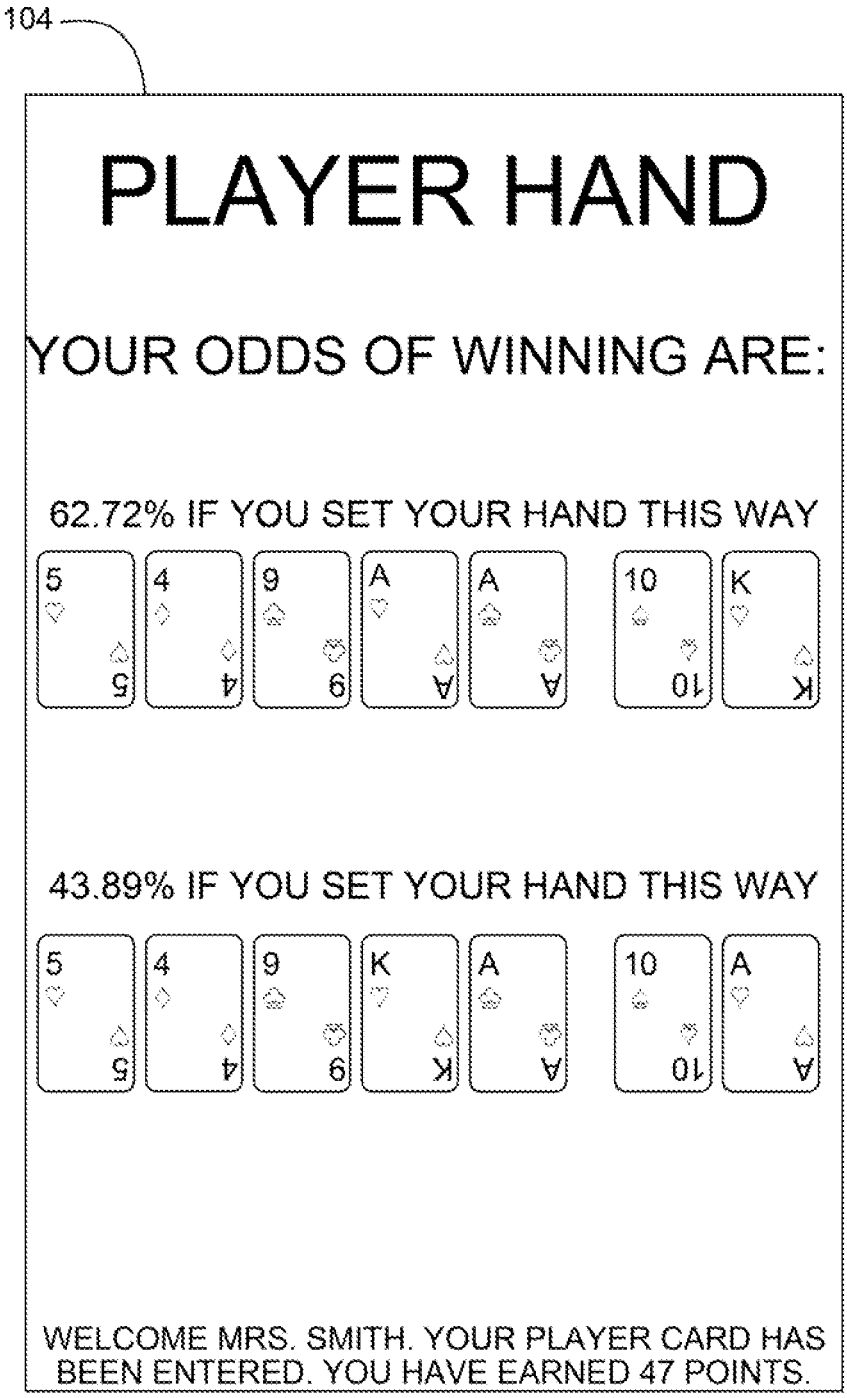
FIG. 7 is a front view of a current game display according to an embodiment of the present invention.

In another optional embodiment directed to Pai Gow Poker, Pai Gow, or the like as illustrated in FIG. 7, a current game display may be generated to display the varying probabilities of "ways" of setting the player's hand. Specifically, in Pai Gow Poker, Pai Gow, and other games, a player is dealt a hand of cards that is divided (or "set") into two (or more, depending on the game) sub-hands. In an optional embodiment, a controller 102 may utilize the data representing the player's hand to analyze the relative strengths of the various ways of setting the player's hand within the scope of the rules of Pai Gow Poker, Pai Gow, or the like. Thus, a current game display may include graphics representing the options (or the top ranking options) for setting the player's hand along with a quantification of the relative strengths of those options. For example, a current game display may display three "ways" of setting a hand, with an indication that the first hand is the strongest with a 40.79% chance of beating any dealer hand, the second hand is the next strongest with a 20.24% chance of beating any dealer hand, and the third hand is the weakest with a 3.01% chance of beating any dealer hand. Alternatively, relative strength scores may be provided without quantifying in terms of winning percentages. In one such example, with an indication that the first hand is the strongest with a strength of 7 on a scale of one to ten, the second hand is the next strongest with a strength of 3, and the third hand is the weakest with strength of 1.

Figure 8:
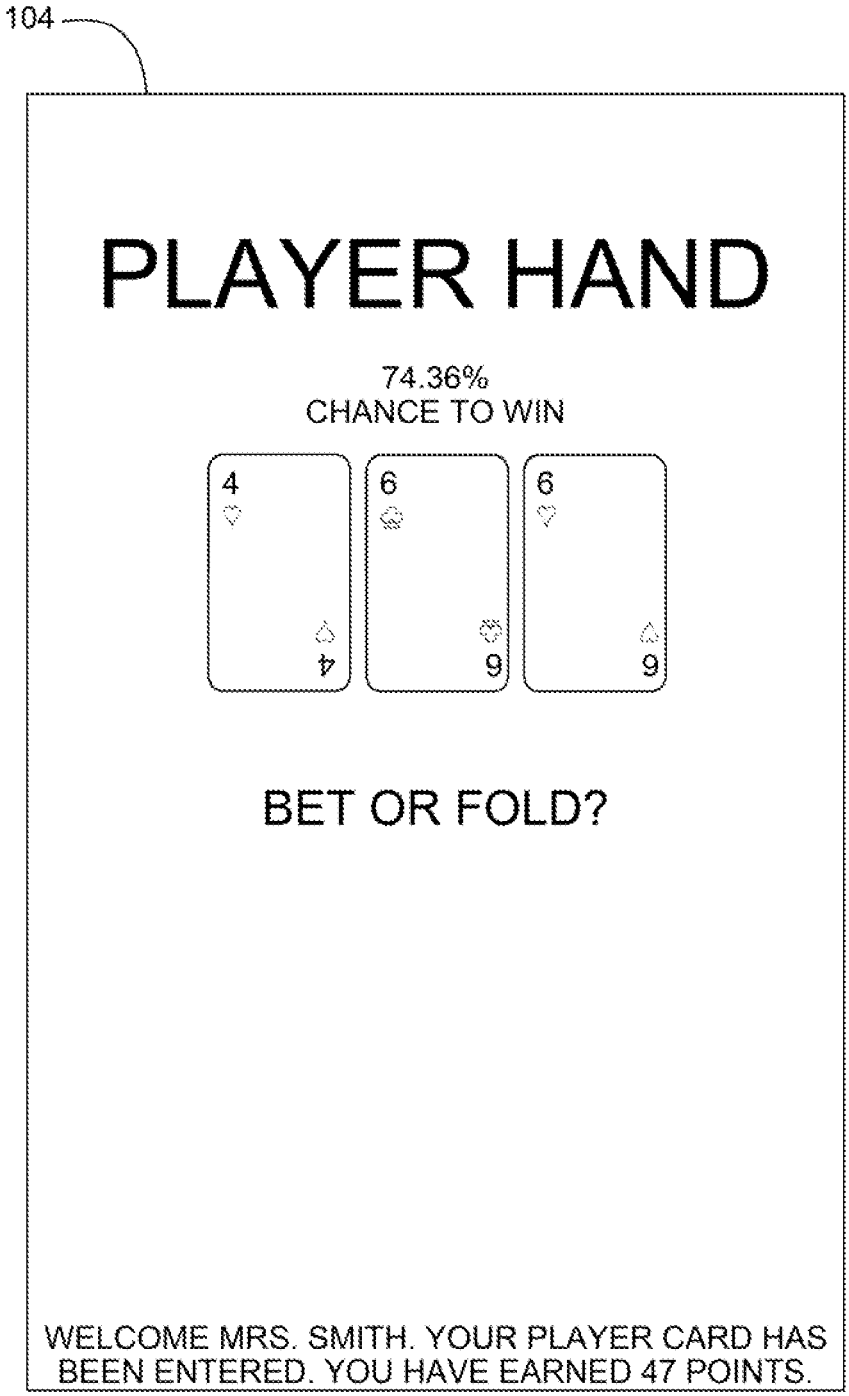
FIG. 8 is a front view of a current game display according to an embodiment of the present invention.

In yet another example, a current game display may provide betting advice to a player. For example, in a game in which the player must bet or check (or bet or fold) during the course of a game, the controller 102 may analyze the player's options and determine the relative strengths, probability of winning, or the like. For example, in an optional embodiment directed to three-card poker such as that illustrated in FIG. 8, a current game display may be generated by a controller 102 analyzing the strength of the player's hand (and, optionally, any exposed cards of the dealer hand in versions that include exposed dealer hand cards) and advise the probability associated with betting or checking, e.g., chance of winning 62.54%.

Figure 9:
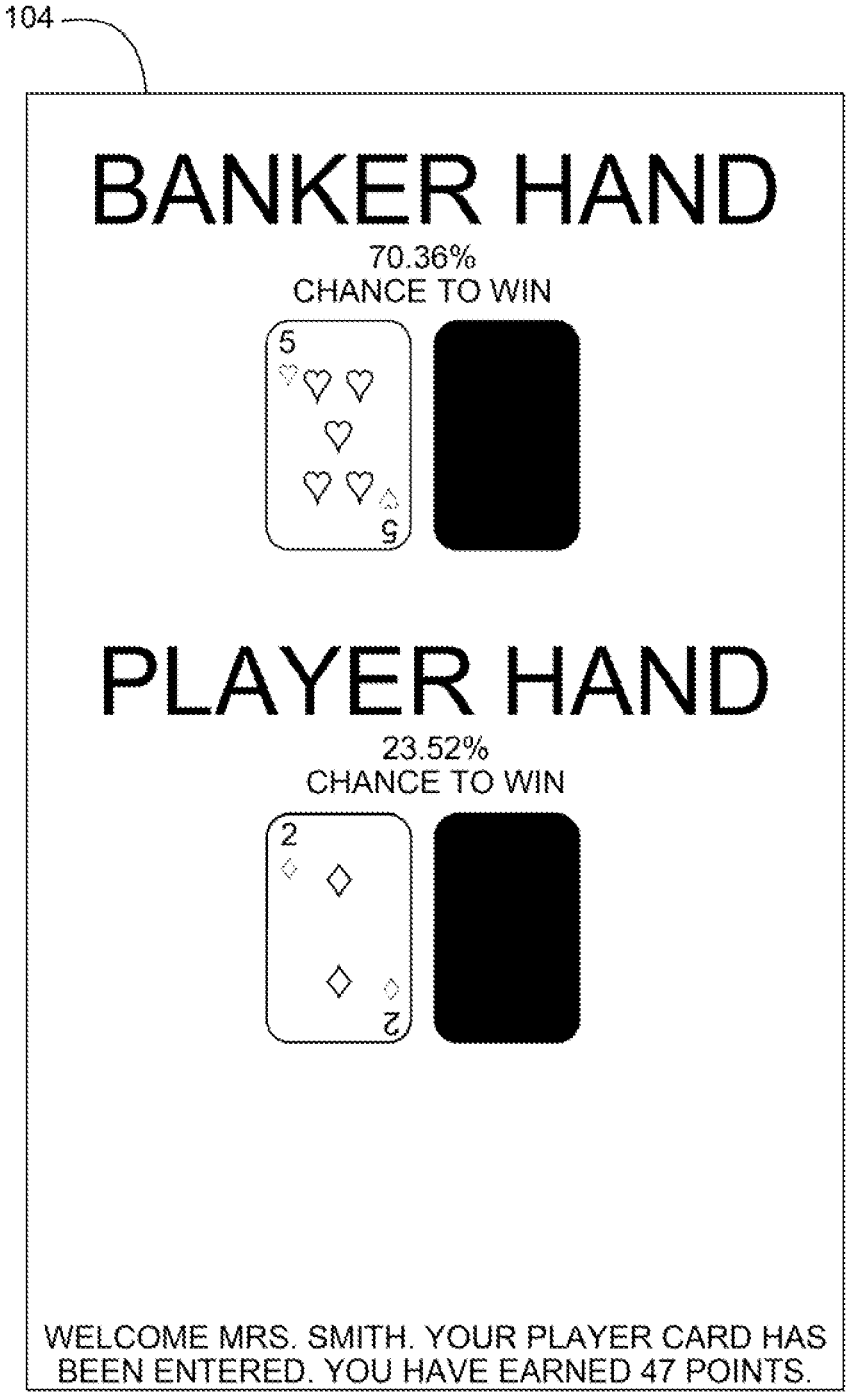
FIG. 9 is a front view of a current game display according to an embodiment of the present invention.

In an example in which community hands are utilized, a controller 102 may compare the relative strengths of the community hands and generate a current game display advising of that relative strength. For example, in one optional embodiment directed to a Baccarat-like game, illustrated in FIG. 9, in which additional wagers may be placed after a portion or all of the cards in one of the player hand and/or banker hand have been exposed, a controller 102 may analyze the exposed cards and generate a current game display of Player Hand 32.73% chance of winning and Banker Hand 62.20% chance of winning, with the balance being the chance of a tie.

Figure 10:
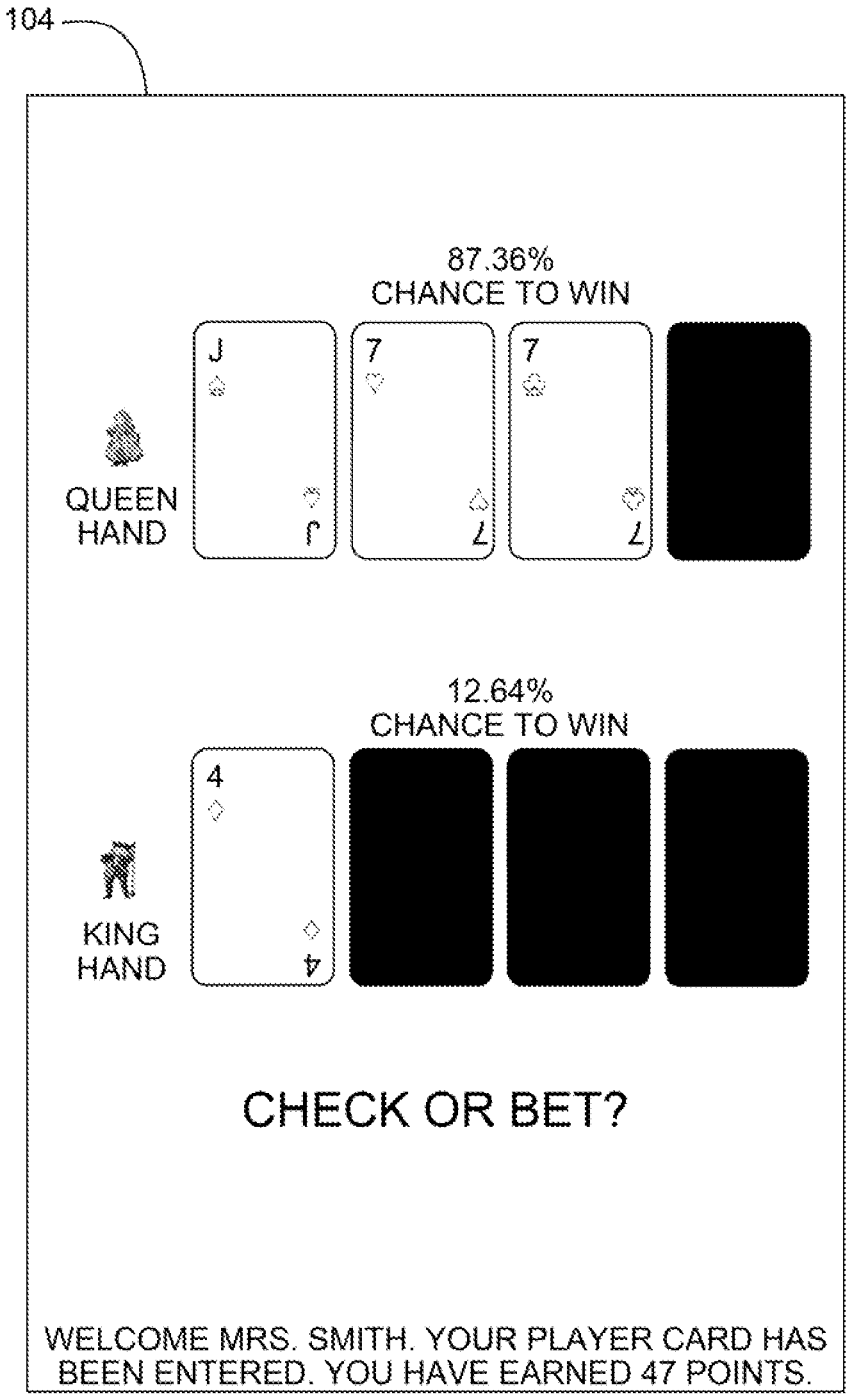
FIG. 10 is a front view of a current game display according to an embodiment of the present invention.

In another such example, a controller 102 may compare the relative strengths of community hands in a poker-type game disclosed in U.S. patent application Ser. No. 13/654,921, which is incorporated herein by this reference. In such an example, illustrated in FIG. 10, a controller 102 may analyze the exposed cards at each stage of a game, determine the relative strengths of the hands at that stage, and generate a current game display of King Hand 73.21% and Queen Hand 26.79%. In such a game, the current game display may change at each stage as additional cards are exposed.

Figure 11:
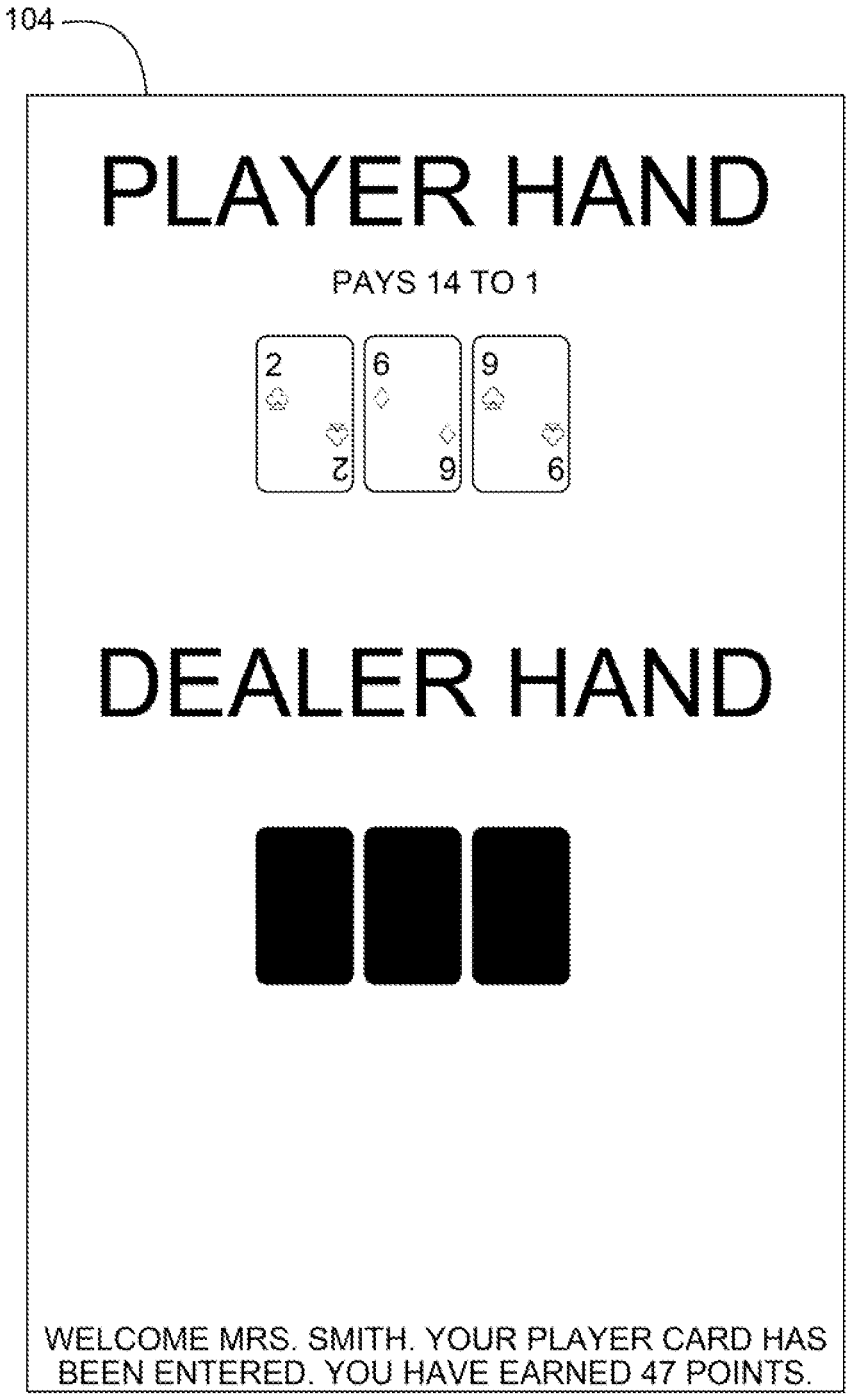
FIG. 11 is a front view of a current game display according to an embodiment of the present invention.

In yet another example, a controller 102 may analyze one or more exposed playing cards and calculate a pay table that is customized to that particular game and game hand. For example, in an optional embodiment, a game hand may be exposed in stages, with bets placed at various stages associated with a pay table dynamically determined for that particular stage. For example, in an optional embodiment illustrated in FIG. 11, at a particular stage, a controller 102 may analyze the exposed cards of two community hands, determine a pay table for that stage, and generate a current game display showing that a bet placed at that stage would be paid 5:1 if the bet wins. As may be appreciated, since the current game display is generated based on the game indicia data collected for that current game, each game will lead to different current game displays.

As discussed above, the current game display is generated by the controller 102, which may merely control a display 104 to show a static display. Alternatively or additionally, the controller 102 may control a display 104 to display graphics, animation, or other dynamic display.

In one optional embodiment, a dynamic display is a prerecorded sequence that is non-interactive. In another optional embodiment, a dynamic display is a sequence that receives player or non-player participant interaction, but which interaction does not affect the current game display, that is, the interaction is illusory.

In an optional embodiment, additional information may be displayed in a current game display. For example, messages to players (such as a welcome message, a "good luck" message, pages or other notifications, player's club messages indicating the scanning of a player club card, the earning of points, etc., or other messages), offers to players (whether customized or general in nature), advertisements, or the like. In one optional embodiment, the controller may customize current game displays, such as animations, offers, messages, or the like, based on the player attitude as discerned from such factors as the player's game history, bet history, winnings or losses, or the like. For example, when a player receives a large payout or has a streak of wins, different animations, offers, and messages may be displayed, as opposed to when a player loses or has a streak of losses. Such messages and animations may be as simple as "congratulations" when a player wins or "better luck next time" when a player loses, or may include offers such as "tickets are still available for tonight's concert" if a player wins or "buy one, get one buffet" when a player loses. It is contemplated that such adaptive displays may also be utilized independent of the display system described herein, such as on electronic gaming machines, personal computers, mobile devices, or the like. For example, in an optional embodiment, a text message may be transmitted to a player's mobile device in addition to, or in place of, displaying the message on a display 104.

While certain embodiments of the present invention have been shown and described it is to be understood that the present invention is subject to many modifications and changes without departing from the spirit and scope of the claims presented herein.

We claim:

1. A system configured to generate a current game display configured for an electronic game machine executing program instructions configured to conduct a game utilizing game indicia dealt to resolve at least one wager, wherein said game includes at least one intermediate point during said game and a final outcome at the end of said game based on at least one random event occurring in said game based on both dealt and undealt game indicia, comprising:

a controller;

a wager detector in communication with said controller;

an input device comprising an optical reader in communication with said controller; and a display in communication with said controller, wherein said controller is configured to execute program instructions to conduct a method comprising:

receiving data at said controller indicating the commencement of a current game;

receiving data at said controller from said input device representing at least one random event that has occurred in said current game prior to said intermediate point, wherein said optical reader is configured to read dealt game indicia and transmit data representing dealt game indicia to said controller wherein said at least one random event comprises data representing both dealt and undealt game indicia;

calculating by said controller the current game state at said intermediate point during said current game based on said data received that represents said at least one random event;

generating by said controller a current game display based on said current game state calculated by said controller;

displaying at said display said current game display at said intermediate point during said game and prior to said final outcome at the end of said game; and detecting receipt of at least one wager at said wager detector after said current game display is displayed, wherein said current game display includes a quantification of the probability that said wager will be won or lost.

2. The system of claim 1 wherein said game state includes a quantification of the probability of a random event that determines, at least in part, said final outcome.

3. The system of claim 1 wherein said final outcome could be a winning outcome or a losing outcome and said game state includes a quantification of the probability of said final outcome being at least one of a winning outcome or a losing outcome.

4. The system of claim 1 wherein said current game display includes a dynamic pay out for said at least one wager, and wherein said dynamic pay out is calculated, at least in part, based on said current game state.

5. A system configured to generate a current game display configured for an electronic gaming machine executing program instructions configured to conduct a game utilizing game indicia dealt to resolve at least one wager, wherein said game includes at least one intermediate point during said game and a final outcome at the end of said game based on at least one random event occurring in said game based on both dealt and undealt game indicia, comprising:

a controller;

a wager detector in communication with said controller;

an input device comprising an optical reader in communication with said controller; and a display in communication with said controller, wherein said controller is configured to execute program instructions to conduct a method comprising:

receiving data at said controller indicating the commencement of a current game;

receiving data at said controller from said input device representing at least one random event that has occurred in said current game prior to said intermediate point, wherein said optical reader is configured to read dealt game indicia and transmit data representing dealt game indicia to said controller wherein said at least one random event comprises data representing both dealt and undealt game indicia;

calculating by said controller the current game state at said intermediate point during said current game based on said data received that represents said at least one random event;

generating by said controller a current game display based on said current game state calculated by said controller; and displaying at said display said current game display at said intermediate point during said game and prior to said final outcome at the end of said game, wherein said current game display includes a quantification of the probability that said wager will be won or lost.

6. The system of claim 5 further comprising a playing card shoe wherein said optical reader is integrated with said playing card shoe.

7. The system of claim 5 further comprising a playing card shuffler wherein said optical reader is integrated with said playing card shuffler.

8. The system of claim 5 further comprising a gaming table wherein said optical reader is embedded into said gaming table.

9. The system of claim 5 wherein said game state includes a quantification of the probability of a random event that determines, at least in part, said final outcome.

10. The system of claim 5 wherein said final outcome could be a winning outcome or a losing outcome and said game state includes a quantification of the probability of said final outcome being at least one of a winning outcome or a losing outcome.

11. The system of claim 5 wherein said current game display includes a dynamic pay out for said at least one wager, and wherein said dynamic pay out is calculated, at least in part, based on said current game state.

12. A system configured to generate a current game display in a game configured to utilize game indicia dealt to resolve at least one wager, wherein said game is configured to include at least one intermediate point during said game and a final outcome at the end of said game based on at least one random event occurring in said game based on both dealt and undealt game indicia, comprising:

a controller;

a wager detector in communication with said controller;

an input device comprising an optical reader in communication with said controller; and a display in communication with said controller, wherein said controller is configured to execute program instructions to conduct a method comprising:

receiving data at said controller indicating the commencement of a current game;

receiving data at said controller from said input device representing at least one random event that has occurred in said current game prior to said intermediate point, wherein said optical reader is configured to read dealt game indicia and transmit data representing dealt game indicia to said controller wherein said at least one random event comprises data representing both dealt and undealt game indicia;

calculating by said controller the current game state at said intermediate point during said current game based on said data received that represents said at least one random event;

generating by said controller a current game display based on said current game state calculated by said controller;

displaying at said display said current game display at said intermediate point during said game and prior to said final outcome at the end of said game; and detecting receipt of at least one wager at said wager detector after said current game display is displayed, wherein said current game display includes a quantification of the probability that said wager will be won or lost.

13. The system of claim 11 further comprising a playing card shoe wherein said optical reader is integrated with said playing card shoe.

14. The system of claim 11 further comprising a playing card shuffler wherein said optical reader is integrated with said playing card shuffler.

15. The system of claim 11 further comprising a gaming table wherein said optical reader is embedded into said gaming table.

16. The system of claim 11 wherein said game state includes a quantification of the probability of a random event that determines, at least in part, said final outcome.

17. The system of claim 11 wherein said final outcome could be a winning outcome or a losing outcome and said game state includes a quantification of the probability of said final outcome being at least one of a winning outcome or a losing outcome.

18. The system of claim 11 wherein said current game display includes a dynamic pay out for said at least one wager, and wherein said dynamic pay out is calculated, at least in part, based on said current game state.

* * * * *